US011065506B2

(12) United States Patent
Lin et al.

(10) Patent No.: US 11,065,506 B2
(45) Date of Patent: Jul. 20, 2021

(54) MUSCLE TRAINING EQUIPMENT, MUSCLE TRAINING SYSTEM AND MUSCLE TRAINING METHOD

(71) Applicant: INDUSTRIAL TECHNOLOGY RESEARCH INSTITUTE, Hsinchu (TW)

(72) Inventors: Tsung-Chi Lin, Taipei (TW); Jyun-Liang Pan, New Taipei (TW); Kai-Jen Pai, New Taipei (TW); Zhong-We Liao, Kaohsiung (TW); Yen-Chung Chang, Zhubei (TW); Szu-Han Tzao, Taipei (TW); Ching Yi Liu, Taichung (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 34 days.

(21) Appl. No.: 16/543,353

(22) Filed: Aug. 16, 2019

(65) Prior Publication Data

US 2020/0070005 A1 Mar. 5, 2020

Related U.S. Application Data

(60) Provisional application No. 62/724,693, filed on Aug. 30, 2018.

(30) Foreign Application Priority Data

Nov. 26, 2018 (TW) ..... 107142051

(51) Int. Cl.
*A63B 24/00* (2006.01)
*A63B 21/078* (2006.01)
(Continued)

(52) U.S. Cl.
CPC ..... *A63B 24/0087* (2013.01); *A63B 21/0058* (2013.01); *A63B 21/078* (2013.01);
(Continued)

(58) Field of Classification Search
CPC ..... A61B 5/11; A61B 5/1107; A61B 5/22; A61B 5/224; A61B 5/24; A61B 5/25;
(Continued)

(56) References Cited

U.S. PATENT DOCUMENTS 5,078,152 A * 1/1992 Bond ..... A63B 24/0003 600/587
5,151,072 A 9/1992 Cone et al.
(Continued)

FOREIGN PATENT DOCUMENTS

CN 101513567 A 8/2009
CN 102727361 A 10/2012
(Continued)

OTHER PUBLICATIONS

TW Office Action in Application No. 107142051 dated Mar. 20, 2020.
(Continued)

*Primary Examiner* — Gary D Urbiel Goldner
(74) *Attorney, Agent, or Firm* — Maschoff Brennan

(57) ABSTRACT

A muscle training system configured to train at least one target muscle of a human body includes a muscle training equipment and a controller. The muscle training equipment includes at least one resistance adjustment assembly and at least one vibration detector. The at least one resistance adjustment assembly is configured to provide a resistance force as a training load. The at least one vibration detector is configured to be disposed on the at least one target muscle and produces at least one muscle vibration signal based on an activity of the at least one target muscle training under the
(Continued)

resistance force. The controller is configured to control the at least one resistance adjustment assembly to adjust the resistance force according to the at least one muscle vibration signal.

14 Claims, 8 Drawing Sheets

(51) Int. Cl.
*A63B 21/005* (2006.01)
*A63B 23/035* (2006.01)

(52) U.S. Cl.
CPC .... *A63B 23/03525* (2013.01); *A63B 24/0062* (2013.01); *A63B 24/0075* (2013.01); *A63B 2024/0068* (2013.01); *A63B 2024/0093* (2013.01); *A63B 2230/605* (2013.01)

(58) Field of Classification Search
CPC ..... A61B 5/296; A61B 5/30; A61B 5/313; A61B 5/316; A61B 5/389; A61B 5/397; A61B 5/45; A61B 5/4519; A61B 5/6813; A61B 5/6823; A61B 5/6824; A61B 5/7225; A61B 5/7282; A63B 24/0062; A63B 24/0075; A63B 24/0084; A63B 24/0087; A63B 2024/0065; A63B 2024/0068; A63B 2024/0078; A63B 2024/0081; A63B 2024/009; A63B 2024/0093; A63B 2024/0096; A63B 71/0619; A63B 71/0622; A63B 2071/065; A63B 2071/0675; A63B 2220/00; A63B 2220/64; A63B 2220/80; A63B 2220/83; A63B 2220/836; A63B 2230/00; A63B 2230/60; A63B 2230/605
See application file for complete search history.

(56) References Cited

U.S. PATENT DOCUMENTS 5,722,420 A * 3/1998 Lee ..... A61H 1/0218 600/546
8,500,608 B1 8/2013 Bonomi
9,269,119 B2 2/2016 Warner
9,682,306 B2 * 6/2017 Lin ..... A63B 22/0605
10,120,455 B2 11/2018 Wu
2006/0252615 A1 11/2006 Melcer
2010/0117837 A1 * 5/2010 Stirling ..... A61B 5/1124 340/573.1
2011/0071002 A1 * 3/2011 Gravel ..... A63B 23/03541 482/7
2012/0004578 A1 1/2012 Wu et al.
2012/0058859 A1 3/2012 Elsom-Cook et al.
2013/0065730 A1 * 3/2013 Camerota ..... A63B 23/0405 482/5
2014/0135593 A1 * 5/2014 Jayalth ..... A41D 1/04 600/301
2014/0163704 A1 * 6/2014 DePietro ..... G01S 19/19 700/91
2016/0361602 A1 * 12/2016 Lagree ..... A61B 5/375
2017/0056275 A1 * 3/2017 Lee ..... A61F 2/72
2017/0095670 A1 * 4/2017 Ghaffari ..... A61B 5/0024
2017/0172491 A1 6/2017 Wu et al.
2018/0214729 A1 * 8/2018 Rubin ..... G16H 20/30
2018/0296879 A1 * 10/2018 Blium ..... A63B 21/4003
2019/0021931 A1 * 1/2019 Shen ..... A63B 24/0087
2019/0027058 A1 * 1/2019 Shattuck ..... A63B 24/0062
2019/0366146 A1 * 12/2019 Tong ..... A61N 1/0476

FOREIGN PATENT DOCUMENTS

CN 101961527 B 11/2013
CN 104317196 A 1/2015
CN 206910696 U 1/2018
TW 200916146 A 4/2009
TW M433885 U 7/2012
TW I481431 B 4/2015
TW I490011 B 7/2015
TW I502389 B 10/2015
TW I583357 B 5/2017
TW I656320 B 4/2019

OTHER PUBLICATIONS

Chen, Application of Observer-based Impedance Control and Passive Velocity Control to Arm Exercise and Rehabilitation Devices (Jun. 27, 2013).
Taiwan Office Action issued in corresponding application No. 107142051, dated Mar. 17, 2021.

* cited by examiner

MUSCLE TRAINING EQUIPMENT, MUSCLE TRAINING SYSTEM AND MUSCLE TRAINING METHOD

CROSS-REFERENCE TO RELATED APPLICATIONS

This non-provisional application claims priority under 35 U.S.C. § 119(a) on Patent Application No(s). 107142051 filed in Taiwan, R.O.C. on Nov. 26, 2018, and on provisional patent application No(s). 62/724,693 filed in U.S.A. on Aug. 30, 2018, the entire contents of which are hereby incorporated by reference.

TECHNICAL FIELD

The disclosure relates to a muscle training equipment, muscle training system and muscle training method, more particularly to a muscle training equipment, muscle training system and muscle training method that are capable of adjusting training load by a resistance adjustment assembly.

BACKGROUND

Driven by the health-conscious lifestyle, today's society pays more and more attention to inner health and external appearances. Exercise workout is an effective way to get fit, burn fat, and strengthen muscle. Therefore, the desire for workout is booming, and more and more gyms, fitness centers, and workout equipment manufacturers have shown up. There are many types of workout equipment in the market, such as weight lifting equipment, PEC machines and rowing machines. The conventional workout equipment uses weight plates or stacks as added resistance, so the users have to load or unload the weight plates or stacks by themselves.

One embodiment of this disclosure provides a muscle training equipment configured to train at least one target muscle of human body and including a frame, at least one vibration detector, and at least one resistance adjustment assembly. The at least one vibration detector is configured to be disposed on the at least one target muscle so as to produce at least one muscle vibration signal based on the activity of the at least one target muscle. The at least one resistance adjustment assembly includes a motor, a handle and a linkage assembly. The motor is disposed on the frame and has a resistance-adjustable shaft. An end of the linkage assembly is fixed to the resistance-adjustable shaft, and another end of the linkage assembly is pivotally connected to the handle. The at least one resistance adjustment assembly is configured to adjust a resistance force applied on the resistance-adjustable shaft according to the at least one muscle vibration signal.

Another embodiment of this disclosure provides a muscle training system configured to train at least one target muscle of human body, and including a muscle training equipment and a controller. The muscle training equipment includes at least one resistance adjustment assembly and at least one vibration detector. The at least one resistance adjustment assembly is configured to provide a resistance force as a training load. The at least one vibration detector is configured to be disposed on the at least one target muscle and produces at least one muscle vibration signal based on the activity of the at least one target muscle training under the resistance force. The controller is configured to control the at least one resistance adjustment assembly to adjust the resistance force according to the at least one muscle vibration signal.

Still another embodiment of this disclosure provides a muscle training method for a muscle training equipment. The muscle training method includes producing at least one current muscle vibration signal based on a current activity of at least one target muscle of human body by using at least one vibration detector, and adjusting a resistance force of at least one resistance adjustment assembly according to the at least one current muscle vibration signal.

BRIEF DESCRIPTION OF THE DRAWINGS

The present disclosure will become better understood from the detailed description given herein below and the accompanying drawings which are given by way of illustration only and thus are not intending to limit the present disclosure and wherein.

DETAILED DESCRIPTION

Figure 1:
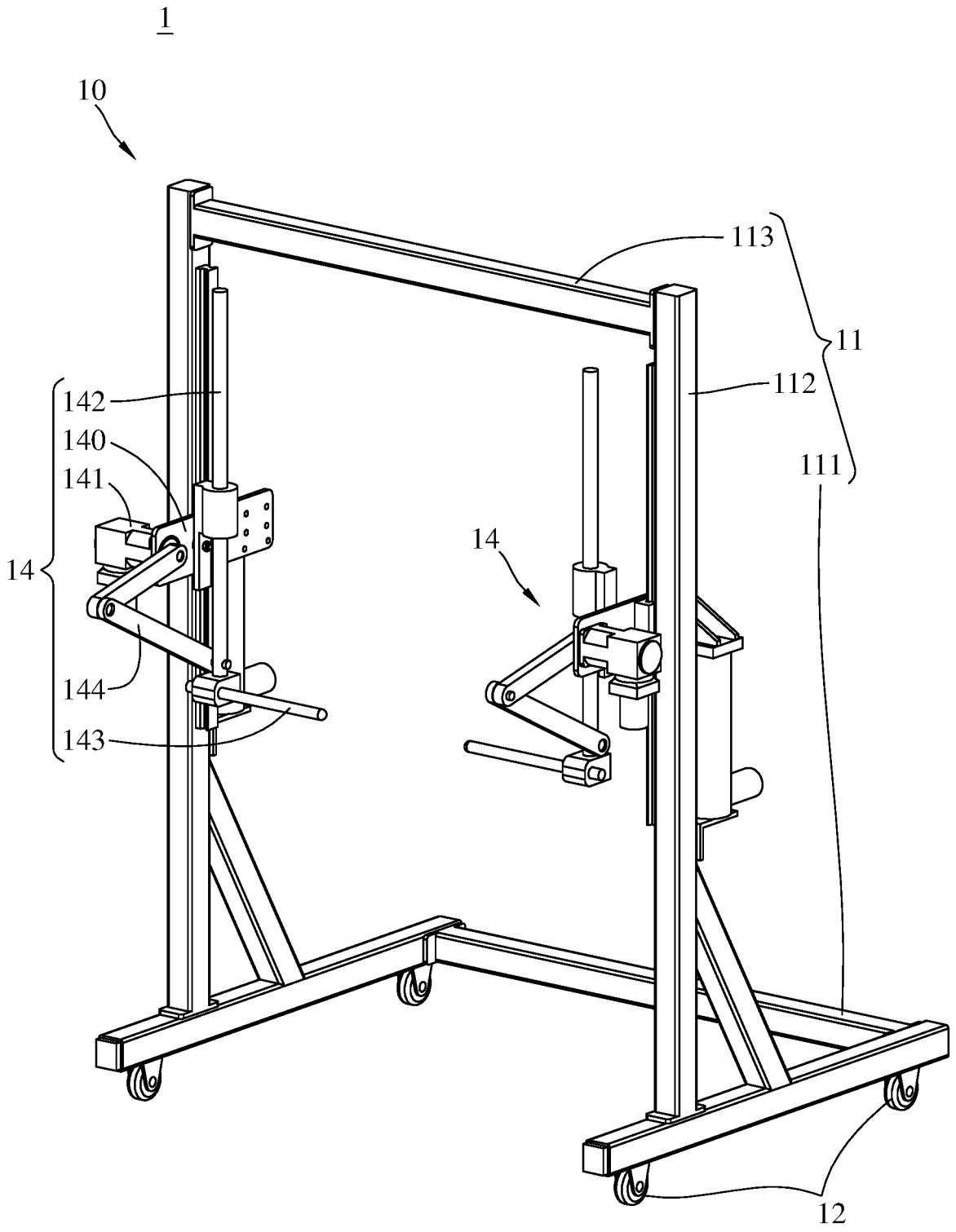
FIG. 1 is a perspective view of a muscle training equipment of a muscle training system according to one embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Specific details and advantages of embodiments of the disclosure are set forth in the following detailed descriptions to provide a thorough understanding of the disclosed embodiments that is comprehensible to the person skilled in the art and the person skilled in the art may practice the disclosed embodiments. It is apparent to the person skilled in the art to understand the objectives and advantages by referring to the specification, the claims and the drawings of the disclosure. The following detailed descriptions are used to further explain the aspects of the disclosure and not intended to limit the disclosure.

In the drawings, size, ratio and angle may be exaggerated for the purpose of illustration, but the disclosure is not limited thereto. Various modifications are allowed as long as they do not violate the spirit of the disclosure. In the specification, the term "on" may be interpreted as "above" or "on an upper surface of another component", the spatial terms, such as "top side", "bottom side", "top" or "bottom", are only used for the purpose of illustration but not intended to limit the disclosure, and the term "substantially" may refer to an equality within the measurement tolerances or the complete or nearly complete extent or degree of an action, characteristic, property, state, structure, item, or result.

Figure 2:
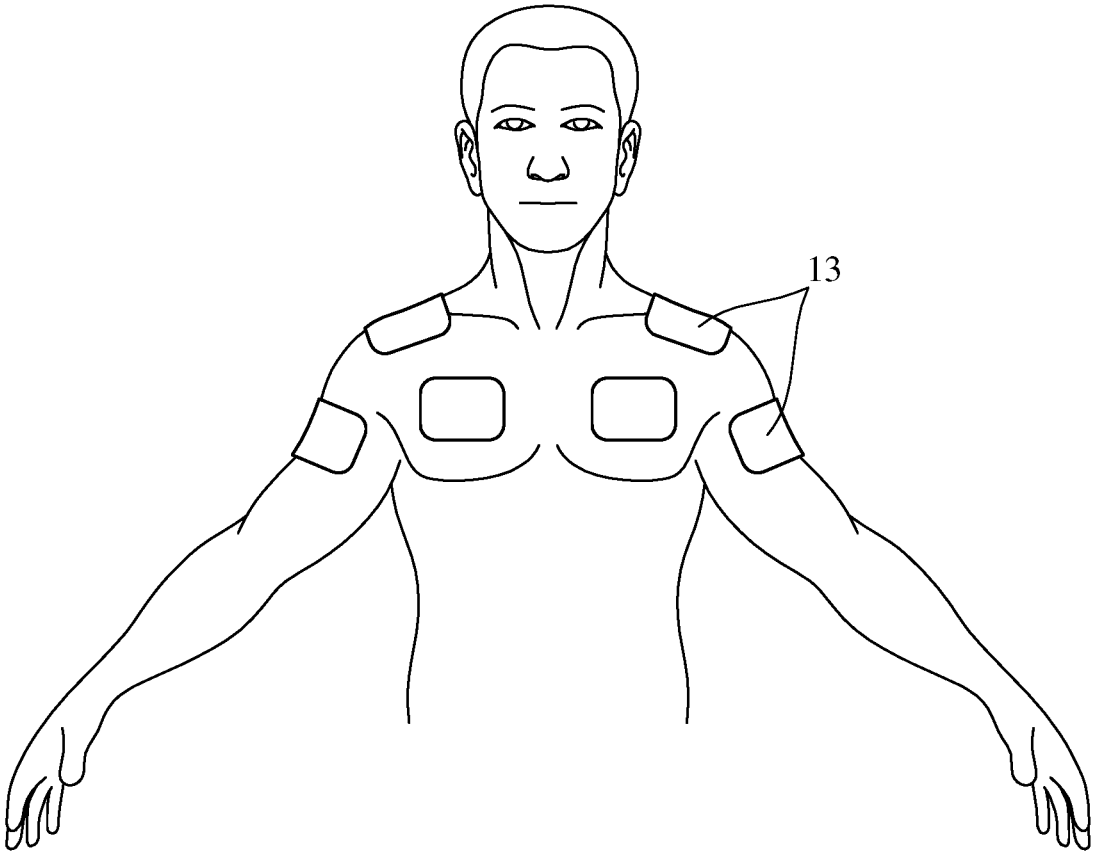
FIG. 2 is a schematic diagram showing that vibration detectors are attached on the muscles of the human body that require training.
Figure 3:
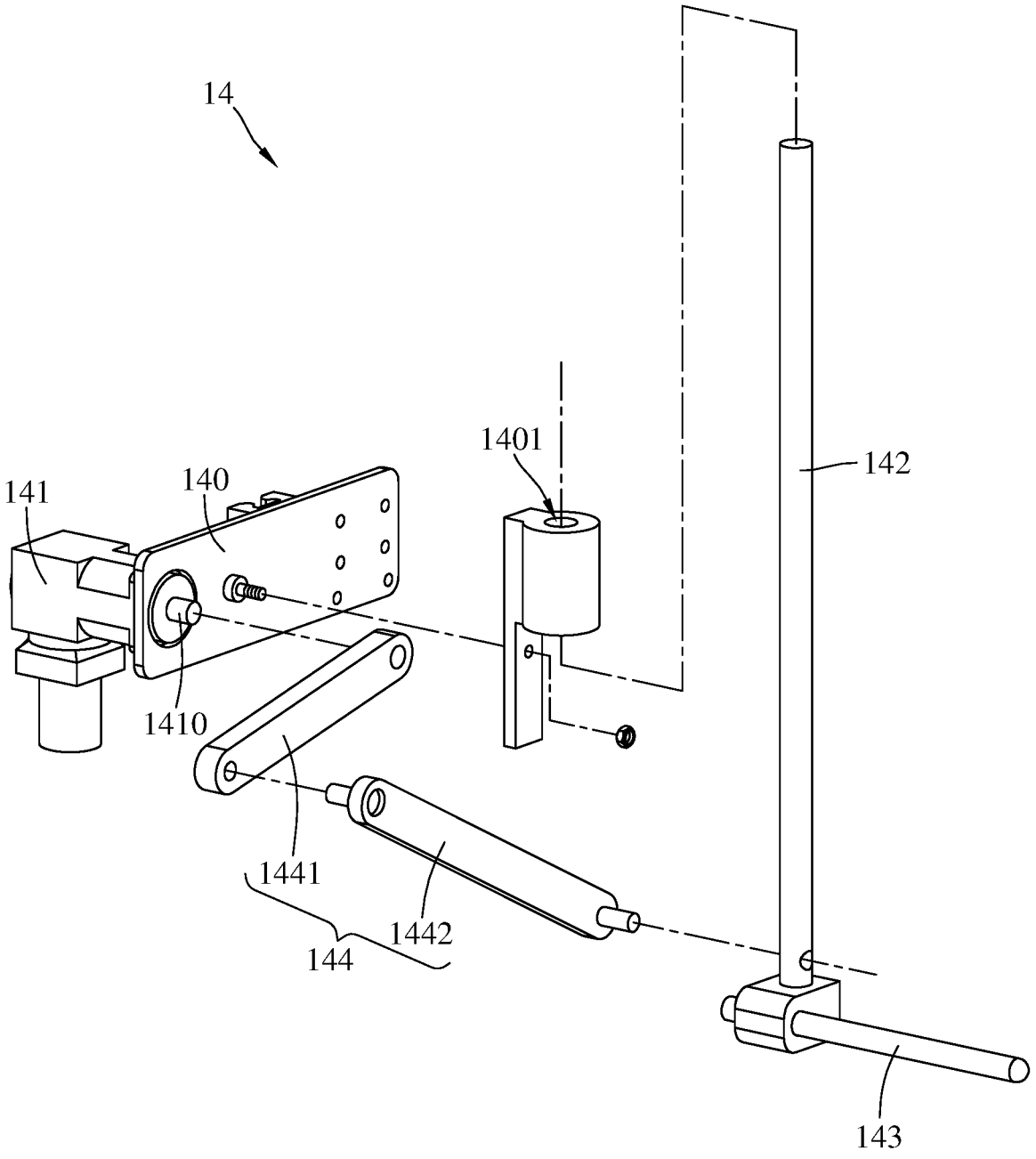
FIG. 3 is an exploded view of a resistance adjustment assembly of the muscle training equipment in FIG. 1.
Figure 4:
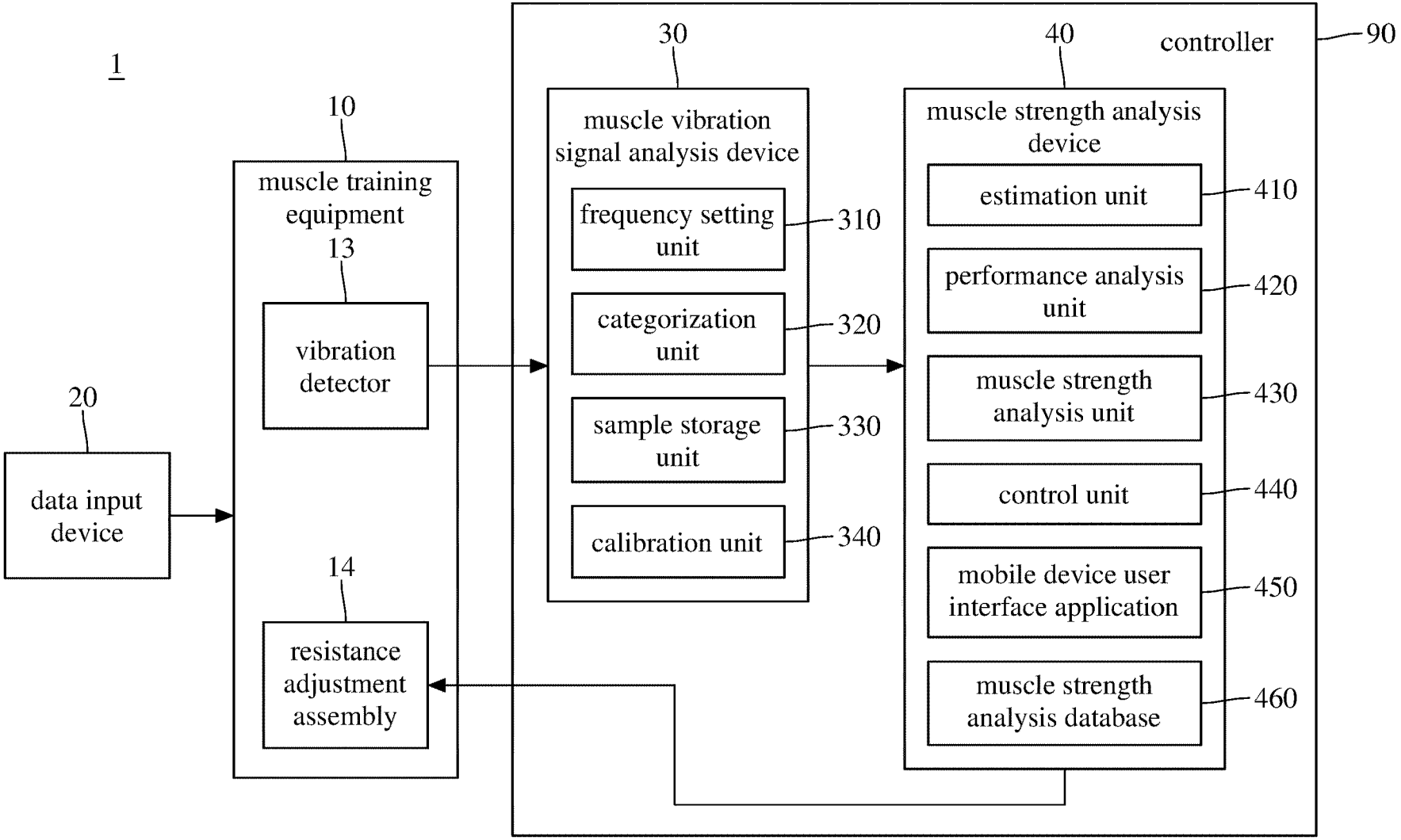
FIG. 4 is a block diagram of the muscle training system in FIG. 1.

Please refer to FIG. 1 to FIG. 4, where FIG. 1 is a perspective view of a muscle training equipment of a muscle training system according to one embodiment of the disclosure, FIG. 2 is a schematic diagram showing that vibration detectors are attached on the muscles of the human body that require training, FIG. 3 is an exploded view of a resistance adjustment assembly of the muscle training equipment in FIG. 1, and FIG. 4 is a block diagram of the muscle training system in FIG. 1.

This embodiment provides a muscle training system 1. The muscle training system 1 includes a muscle training equipment 10, a data input device 20 and a controller 90.

The muscle training equipment 10 includes a frame 11, a plurality of rollers 12, a plurality of vibration detectors 13, and two resistance adjustment assemblies 14.

The frame 11 includes a base part 111, two side parts 112, and a top part 113. The two side parts 112 are respectively disposed on two opposite sides of the base part 111, and two opposite ends of the top part 113 are respectively connected to two ends respectively of the two side parts 112 that are located away from the base part 111.

The rollers 12 are disposed on the base part 111 and are respectively located on corners of the base part 111 so that the muscle training equipment 10 can be moved and slide on the floor. However, the rollers 12 are optional; in other embodiments, the muscle training equipment may not include the rollers.

As shown in FIG. 2, each of the vibration detectors 13 includes a gravity sensor (G-sensor). The vibration detectors 13 can be attached to the muscles of the human body, such as pectoralis major, deltoid, and biceps, so as to detect the frequency and magnitude of the vibration of these muscles fibers occurring during training and convert them into a muscle vibration signal. For example, during the chest press training on the muscle training equipment 10, the vibration detectors 13 can be attached to the chest to produce the muscle vibration signal of the chest muscles. The muscle vibration signal is, for example, a Mechanomyogram (MMG) signal.

Two resistance adjustment assemblies 14 are respectively disposed on the two side parts 112, and each of the two resistance adjustment assemblies 14 includes a base 140, a motor 141, a guide rod 142, a handle 143, and a linkage assembly 144.

The base 140 is movably disposed on the side part 112 so that the height of the base 140 is adjustable. In this embodiment, the base 140 is, for example, movably disposed on the side parts 112 via a hydraulic mechanism, but the disclosure is not limited thereto.

As shown in FIG. 3, an exploded view of the resistance adjustment assembly 14 is provided. The motor 141 is fixed on the base 140 and has a resistance-adjustable shaft 1410. In this embodiment, the motor 141 is, for example, a compliance control motor such as a stepper motor or a servomotor. The force exerted by the user can cause the resistance-adjustable shaft 1410 to rotate in the same direction, and the rotational speed is determined by the magnitude of such force. In a permanent-magnet synchronous motor (PMSM), the rotor has a magnet, and the stator and the rotor have different numbers of teeth, such that there is a minimum magnetic resistance as the PMSM is in the static state, and the minimum magnetic resistance of the PMSM is considered as a resistance force. In the embodiment of the disclosure, such resistance force can oppose the external force applied on the resistance-adjustable shaft 1410. When the external force applied on the resistance-adjustable shaft 1410 is larger than the resistance force of the resistance-adjustable shaft 1410, the external force can force the resistance-adjustable shaft 1410 to rotate in a desired direction, and the rotational speed of the resistance-adjustable shaft 1410 is proportional to the external force applied on the resistance-adjustable shaft 1410. In addition, when three of four coils wrapped on the stator are electrically connected, the voltage will be changed and the force applied on the resistance-adjustable shaft 1410 in the static state will be changed accordingly, such that the resistance force of the resistance-adjustable shaft 1410 is able to be adjusted.

The guide rod 142 is slidably disposed through a guide hole 1401 of the base 140. The handle 143 is disposed on the guide rod 142 for the user to operate the guide rod 142. In this embodiment, the position of the guide hole 1401 is fixed so that the guide rod 142 is only allowed to slide along a fixed direction, but the disclosure is not limited thereto. In other embodiments, the position of the guide hole 140 is adjustable, such that the guide rod is allowed to be slide along different directions so as to fit different training programs. In addition, the disclosure is not limited to the form of the handle 143; in other embodiments, the handle may be a ring-shaped handle, allowing the user to operate the guide rod with different positions.

The linkage assembly 144 includes a first linkage 1441 and a second linkage 1442 that are pivotally connected to each other. An end of the first linkage 1441 which is opposite to the second linkage 1442 is fixed to the resistance-adjustable shaft 1410; that is, two opposite ends of the first linkage 1441 are respectively connected to the second linkage 1442 and the resistance-adjustable shaft 1410. An end of the second linkage 1442 which is opposite to the first linkage 1441 is pivotally connected to the guide rod 142; that is, two opposite ends of the second linkage 1442 are respectively connected to the first linkage 1441 and the guide rod 142. Therefore, when the user slides the guide rod 142 relative to the guide hole 1401 by moving the handle 143, the guide rod 142 forces the linkage assembly 144 to move so as to rotate the resistance-adjustable shaft 1410. Meanwhile, the motor 14 will provide a certain amount of force on the resistance-adjustable shaft 1410 against the force that the user exerts on the resistance-adjustable shaft 1410 by moving the handle 143, such that the force that the motor 141 applies on the resistance-adjustable shaft 1410 becomes a training load that the user needs to deal with.

The disclosure is not limited to the configuration of the resistance adjustment assembly 14; in other embodiments, the second linkage may have a protrusion slidably located in a guide groove of the frame, such that the handle that is fixed on the second linkage is able to be slide along a fixed direction; in such a case, the guide rod 142 can be removed from the resistance adjustment assembly.

Figure 5:
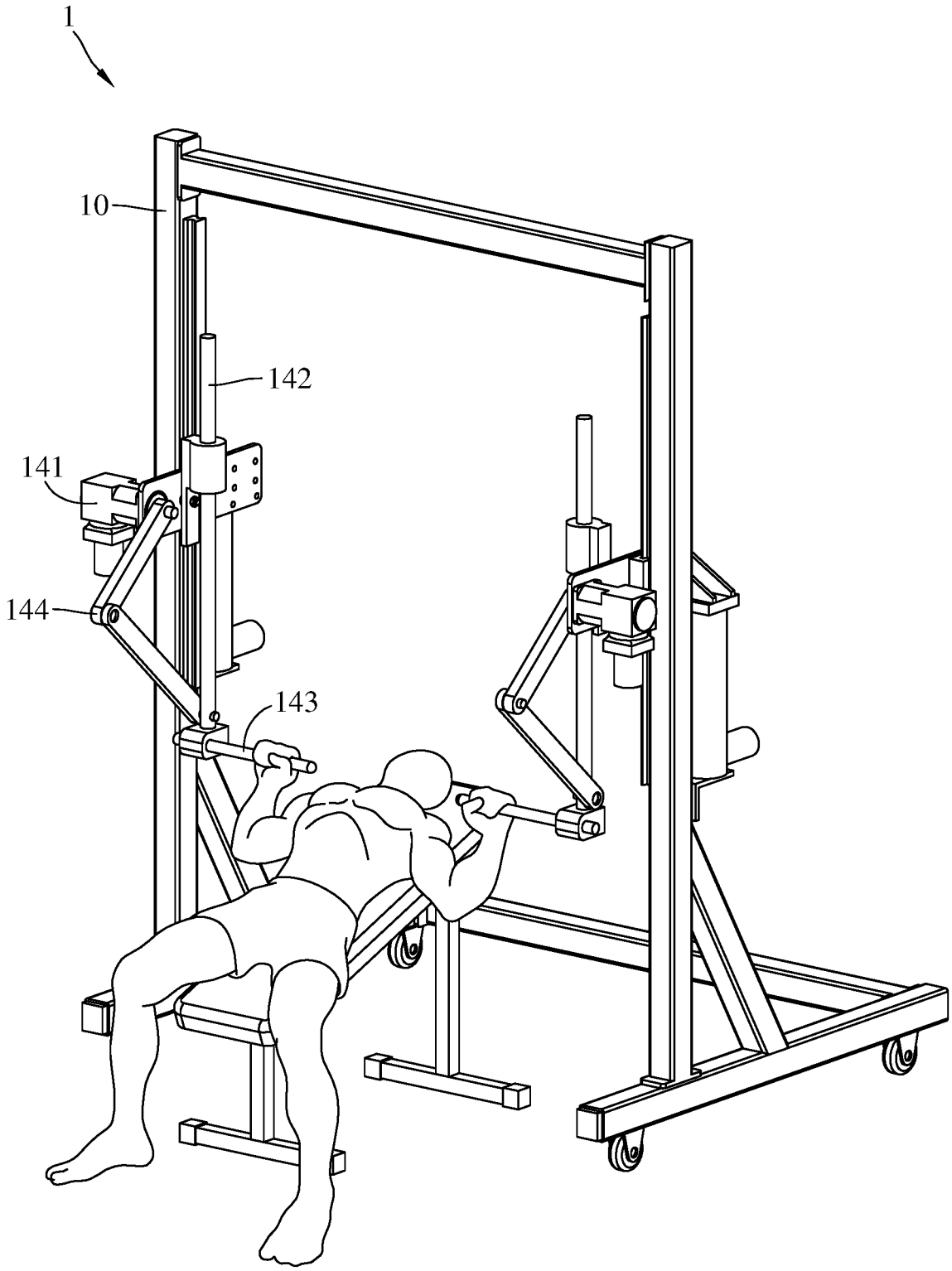
FIG. 5 and FIG. 6 are perspective views illustrating the operation of the muscle training equipment in FIG. 1; and FIG. 7A
Figure 6:
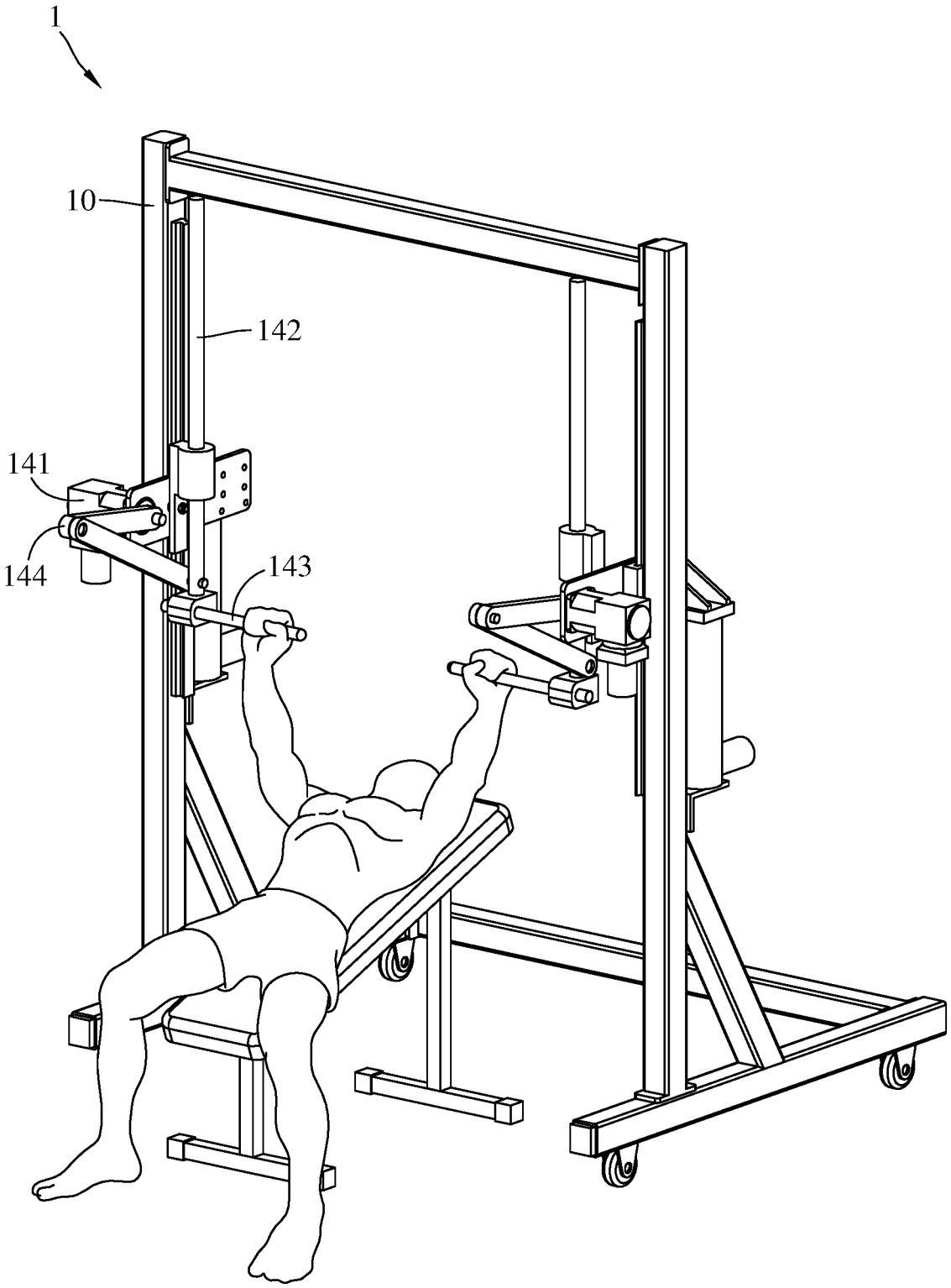

In this embodiment, the muscle training equipment 10 of the muscle training system 1 is a multi-functional muscle training equipment that combines various training functions, such as chest press and squat movements. For example, please refer to FIG. 5 and FIG. 6 showing the chest press movement on the muscle training equipment 10. When the user exerts a force larger than the resistance force of the resistance-adjustable shaft 1410, the handle 143 and the guide rod 142 can be moved upward (as shown in FIG. 6), and when the user exerts a force smaller than the resistance force of the resistance-adjustable shaft 1410, the resistance-adjustable shaft 1410 can move the linkage assembly 144 to force the guide rod 142 and the handle 143 to move downward (as shown in FIG. 5).

The disclosure is not limited to the type of the muscle training equipment 10. In other embodiments, the muscle training equipment may be a PEC machine or rowing machine with the aforementioned vibration detector and resistance adjustment assembly. Different types of muscle training equipment may have different quantities of adjustment assembly; for example, the rowing machine may only have one resistance adjustment assembly. Also, different types of muscle training equipment may have different quantities of vibration detector. In one embodiment, the muscle training equipment may only have one vibration detector.

The data input device 20 allows input including the information of the muscles or training programs and the resistance setting of the resistance adjustment assemblies 14.

The controller 90 includes a muscle vibration signal analysis device 30 and a muscle strength analysis device 40.

The muscle vibration signal analysis device 30 includes a frequency setting unit 310, a categorization unit 320, a sample storage unit 330 and a calibration unit 340.

The frequency setting unit 310 is configured to determine a sampling frequency for sampling the muscle vibration signal produced by the vibration detector 13. The categorization unit 320 is configured to categorize the conditions of the target muscles. The sample storage unit 330 is configured to store the resistance value and muscle vibration signal during the training. The calibration unit 340 is configured to calibrate the muscle vibration signal and outputs a training record data according to the muscle vibration signals. The training record data includes, for example, a muscle data report with the values of muscle activity and training efficiency data, where the values of muscle activity and the training efficiency data are generated by using numerical analysis method to calculate the resistance value and muscle vibration signal during the training.

The muscle strength analysis device 40 includes an estimating unit 410, a performance analysis unit 420, a muscle strength analysis unit 430, a control unit 440, a mobile device user interface application 450, and a muscle strength analysis database 460.

The estimating unit 410 is configured to build a muscle data model of the target muscle based on the training record data produced during the training. The muscle data model includes, for example, various values of muscle activity and training efficiency data, which are derived from the frequency and magnitude of the vibration of the target muscles that were recorded, under different resistances. The estimating unit 410 is able to build a specific muscle data model for each target muscle. The muscle data model built at the first set of training can be stored in the muscle strength analysis database 460.

The performance analysis unit 420 is configured to compare the current training record data of the current training and the other training record data which had been stored in the muscle strength analysis database 460 to generate a difference value, and the performance analysis unit 420 is able to convert the difference value into a training performance data.

The muscle strength analysis unit 430 is configured to determine whether the difference value is within an allowable range and to determine whether the difference value is positive or negative when the difference value is determined to be within the allowable range. In this embodiment, the allowable range is used to determine whether the loading of the current training fits the user; for examples, when the difference value is within the allowable range, it may represent that the current load is suitable for the user; when the difference value is positive, it may represent that the current load exceeds the capability of the user, and which may be resulted from a decrease in muscle strength or muscle fatigue; when the difference value is negative, it may represent that the current load is not enough to reach the requirement of the training program, and which may be resulted from an increase in muscle strength.

The control unit 440 is configured to output a resistance control instruction according to the determination result of the muscle strength analysis unit 430 so as to control the motor 141 to adjust the resistance force output from the resistance-adjustable shaft 1410, thereby adjusting the training load. The resistance control instruction is, for example, one of a resistance maintaining signal, a resistance decreasing signal and a resistance increasing signal; in detail, when the muscle strength analysis unit 430 determines that the difference value is within the allowable range, the control unit 440 outputs the resistance maintaining signal to the resistance adjustment assemblies 14 so that the resistance force produced by the resistance adjustment assemblies 14 does not change; when the muscle strength analysis unit 430 determines that the difference value is not within the allowable range and is positive, the control unit 440 outputs the resistance decreasing signal to the resistance adjustment assemblies 14 so that the resistance adjustment assemblies 14 decreases the resistance force; when the muscle strength analysis unit 430 determines that the difference value is not within the allowable range and is negative, the control unit 440 outputs the resistance increasing signal to the resistance adjustment assemblies 14 so that the resistance adjustment assemblies 14 increases the resistance force. The adjustment unit of the resistance force is, for example, five kilograms, but the disclosure is not limited thereto.

The mobile device user interface application 450 is configured to display the training performance data generated by the performance analysis unit 420. In some embodiments, the muscle strength analysis database 460 is also able to store the training performance data.

Figure 7A:
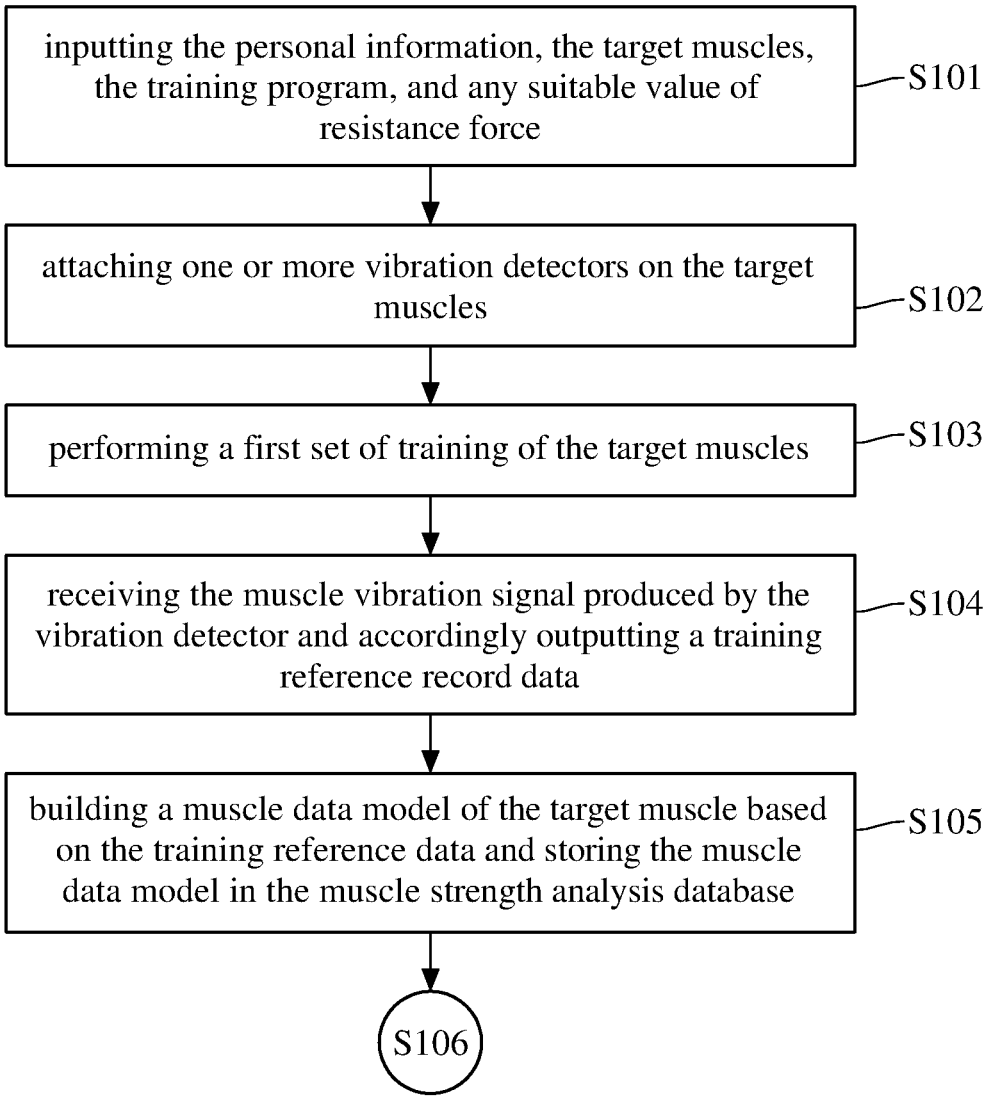
FIG. 7B is a flow chart showing an operation of the muscle training system in FIG. 1.
Figure 7B:
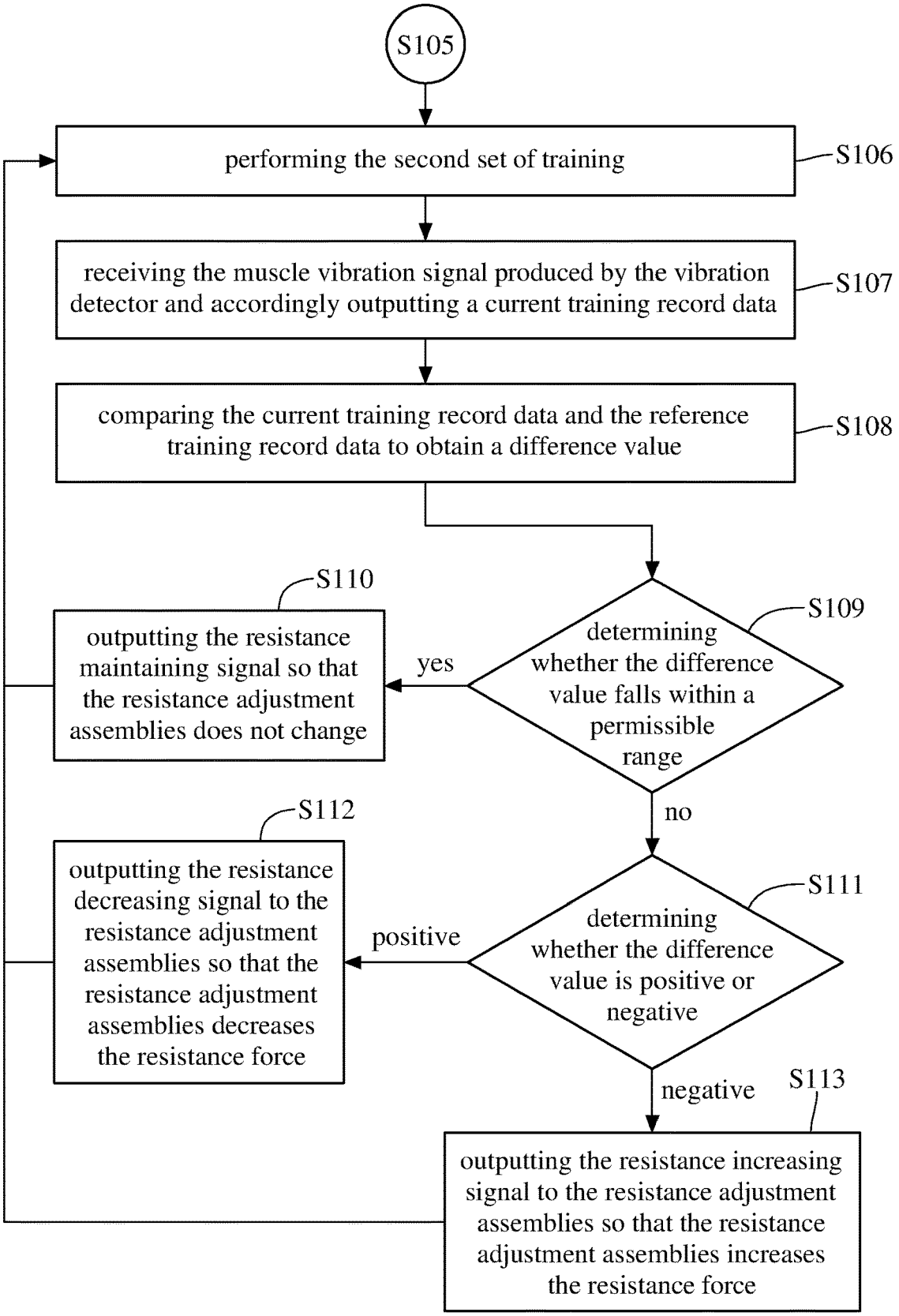

Then, the operation of the muscle training system 1 will be described hereinafter. As shown in FIG. 7A and FIG. 7B, a flow chart of the operation of the muscle training system in FIG. 1 is provided.

For the first time that the user uses the muscle training equipment 10, the user can use the data input device 20 to input the personal information, the target muscles, the training program, and any suitable value of resistance force (step S101). Before or after the step S101, the user can attach one or more vibration detectors 13 on the target muscles (step S102).

Then, a first set of training of the target muscles is performed based on the set program (step S103). During the first set of training, the muscle vibration signal analysis device 30 receives the muscle vibration signal produced by the vibration detector 13 and accordingly outputs a reference training record data (step S104).

The estimating unit 410 of the muscle strength analysis device 40 builds a muscle data model of the target muscle based on the reference training record data, and the muscle data model is stored in the muscle strength analysis database 460 (step S105).

Then, the second set of training is performed (step S106). During the second set of training, the muscle vibration signal analysis device 30 receives the muscle vibration signal produced by the vibration detector 13 and accordingly outputs a current training record data (step S107).

The performance analysis unit 420 of the muscle strength analysis device 40 compares the current training record data and the reference training record data which had been stored in the muscle strength analysis database 460 to generate a difference value and converts the difference value into a training performance data (step S108). Then, the muscle strength analysis unit 430 determines whether the difference value is within an allowable range (step S109). When the muscle strength analysis unit 430 determines that the difference value is within the allowable range, it represents that the current training load is suitable for the user, so the control unit 440 outputs the resistance maintaining signal, as a result, the resistance force produced by the resistance adjustment assemblies 14 does not change (step S110). When the muscle strength analysis unit 430 determines that the difference value is not within the allowable range, the muscle strength analysis unit 430 further determines whether the difference value is positive or negative (step S111). When the muscle strength analysis unit 430 determines that the different value is positive, it represents that the current training load exceeds the capability of the user, so the control unit 440 outputs the resistance decreasing signal to the resistance adjustment assemblies 14, as a result, the resistance adjustment assemblies 14 decreases the resistance force (step S112). When the muscle strength analysis unit 430 determines that the different value is negative, it represents that the current training load is not enough to reach the requirement of the training program, so the control unit 440 outputs the resistance increasing signal to the resistance adjustment assemblies 14, as a result, the resistance adjustment assemblies 14 increases the resistance force (step S113).

As such, the user is allowed to adjust the resistance force of the resistance adjustment assemblies 14 for the next set of training or the resistance adjustment assemblies 14 are able to automatically adjust the resistance force and result in repeatedly performing of the above steps S106 to S113.

During the above operation, the user is allowed to monitor some information, such as the training performance data and the training load of the current resistance force, from the mobile device user interface application 450. By doing so, the user may refer to such information to adjust the training plan. For example, in the case that the mobile device user interface application 450 shows that the training performance data for the chest, the upper arm, and the shoulders respectively are 60%, 10% and 30% during the training, the user may take it as a reference to adjust the next training program, such as to increase the muscle activity of upper arm.

The mobile device user interface application 450 may be integrated with the data input device 20, such that the user is allowed to use the mobile device user interface application 450 to input the information of the target muscles or training programs and the value of the required resistance force of the resistance adjustment assemblies 14.

Additionally, in other embodiments, the muscle training equipment may further include a display panel for timely displaying the current training load and training performance data.

Furthermore, during the operation of the muscle training equipment 10, the muscle strength analysis unit 430 of the muscle strength analysis device 40 may determine whether the muscle fatigue of the target muscles occurs based on the difference value between the current training record data and the reference training record data. As the muscle fatigue of the target muscles reaches a certain level, the control unit 440 is able to immediately output the resistance decreasing signal to the resistance adjustment assemblies 14 so as to decrease the resistance force of the resistance adjustment assemblies 14, thereby avoiding the risk of injury.

In this or other embodiments, the muscle strength analysis database 460 of the muscle strength analysis device 40 is able to store the muscle data models of the target muscles for the future usage, such as being taken as a reference for comparison with the next training record data. Therefore, in the next training program, the aforementioned steps S103 to S105 may be omitted.

Moreover, in this or other embodiments, the estimating unit 410 of the muscle strength analysis device 40 is able to update the muscle data model based on the current training record data so as to timely reflect the recent states of the target muscles. It is understood that the reference training record data is the last previous training record data and can be obtained at any time point before the current training record date.

It will be apparent to those skilled in the art that various modifications and variations can be made to the present disclosure. It is intended that the specification and examples be considered as exemplary embodiments only, with a scope of the disclosure being indicated by the following claims and their equivalents.

What is claimed is:

1. A muscle training system, configured to train at least one target muscle of a human body, the muscle training system comprising:

a muscle training equipment, comprising at least one resistance adjustment assembly and at least one vibration detector, wherein the at least one resistance adjustment assembly is configured to provide a resistance force as a training load, the at least one vibration detector is configured to be disposed on the at least one target muscle and produces at least one muscle vibration signal based on an activity of the at least one target muscle training under the resistance force; and a controller, configured to control the at least one resistance adjustment assembly to adjust the resistance force according to the at least one muscle vibration signal; wherein the controller is configured to compare a training record data according to the at least one muscle vibration signal to a reference training record data so as to generate a difference value;

when the difference value is determined to be within an allowable range by the controller, the controller instructs the at least one resistance adjustment assembly to not change the resistance force;

when the difference value is determined to be positive and not within the allowable range by the controller, the controller instructs the at least one resistance adjustment assembly to decrease the resistance force; and when the difference value is determined to be negative and not within the allowable range by the controller, the controller instructs the at least one resistance adjustment assembly to increase the resistance force.

2. The muscle training system according to claim 1, further comprising a data input device, wherein the data input device is configured for an input of a value of the resistance force of the at least one resistance adjustment assembly.

3. The muscle training system according to claim 1, wherein the controller comprises a muscle vibration signal analysis device and a muscle strength analysis device, the muscle vibration signal analysis device is configured to output the training record data according to the at least one muscle vibration signal, the muscle strength analysis device is configured to analyze the training record data and output a resistance control instruction, and the at least one resistance adjustment assembly adjusts the resistance force according to the resistance control instruction.

4. The muscle training system according to claim 3, wherein the resistance control instruction comprises one of a resistance maintaining signal, a resistance increasing signal and a resistance decreasing signal; wherein if the resistance control instruction comprises the resistance maintaining signal, when the muscle strength analysis device outputs the resistance maintaining signal to the at least one resistance adjustment assembly, the at least one resistance adjustment assembly does not change the resistance force; wherein if the resistance control instruction comprises the resistance increasing signal, when the muscle strength analysis device outputs the resistance increasing signal to the at least one resistance adjustment assembly, the at least one resistance adjustment assembly increases the resistance force; wherein if the resistance control instruction comprises the resistance decreasing signal, when the muscle strength analysis device outputs the resistance decreasing signal to the at least one resistance adjustment assembly, the at least one resistance adjustment assembly decreases the resistance force.

5. The muscle training system according to claim 4, wherein the muscle strength analysis device is configured to compare the training record data and the reference training record data stored in a muscle data model to generate the difference value, the muscle strength analysis device is configured to determine whether the difference value is within the allowable range; when the difference value is determined to be within the allowable range and if the resistance control instruction comprises the resistance maintaining signal, the muscle strength analysis device outputs the resistance maintaining signal to the at least one resistance adjustment assembly; when the difference value is determined to be not within the allowable range and if the resistance control instruction comprises the resistance increasing signal or the resistance decreasing signal, the muscle strength analysis device further determines whether the difference value is positive or negative; when the difference value is determined to be positive and if the resistance control instruction comprises the resistance decreasing signal, the muscle strength analysis device outputs the resistance decreasing signal to the at least one resistance adjustment assembly; when the difference value is determined to be negative and if the resistance control instruction comprises the resistance increasing signal, the muscle strength analysis device outputs the resistance increasing signal to the at least one resistance adjustment assembly.

6. The muscle training system according to claim 5, wherein the muscle strength analysis device comprises an estimating unit, a performance analysis unit, a muscle strength analysis unit and a control unit, the estimating unit is configured to build the muscle data model of the at least one target muscle based on the reference training record data, the performance analysis unit is configured to compare the training record data and the reference training record data so as to generate the difference value and convert the difference value into a training performance data, the muscle strength analysis unit is configured to determine whether the difference value is within the allowable range, the muscle strength analysis unit is further configured to determine whether the difference value is positive or negative when the difference value is determined to be not within the allowable range, and the control unit is configured to output the resistance control instruction.

7. The muscle training system according to claim 6, wherein the muscle strength analysis device further comprises a mobile device user interface application and a muscle strength analysis database, the mobile device user interface application is configured to display the training performance data, and the muscle strength analysis database is configured to store the training performance data.

8. The muscle training system according to claim 6, wherein the muscle training equipment further comprises a display panel configured to display the training performance data.

9. The muscle training system according to claim 3, wherein the muscle vibration signal analysis device comprises a frequency setting unit, a categorization unit, a sample storage unit and a calibration unit, the frequency setting unit is configured to determine a sampling frequency for sampling the at least one muscle vibration signal, the categorization unit is configured to categorize conditions of the at least one target muscle, the sample storage unit is configured to store the at least one muscle vibration signal, and the calibration unit is configured to calibrate the at least one muscle vibration signal and output the training record data according to the at least one muscle vibration signal.

10. A muscle training method for a muscle training equipment, and the muscle training method comprising:

producing at least one current muscle vibration signal based on a current activity of at least one target muscle of a human body by using at least one vibration detector; and adjusting a resistance force of at least one resistance adjustment assembly according to the at least one current muscle vibration signal;

comparing a current training record data according to the at least one current muscle vibration signal and a reference training record data of a muscle data model so as to generate a difference value;

maintaining the resistance force when the difference value is determined to be within an allowable range;

decreasing the resistance force when the difference value is determined to be positive and not within the allowable range; and increasing the resistance force when the difference value is determined to be negative and not within the allowable range.

11. The muscle training method according to claim 10, further comprising inputting a value of the resistance force through a data input device.

12. The muscle training method according to claim 10, wherein the step of adjusting the resistance force of the at least one resistance adjustment assembly according to the at least one current muscle vibration signal further comprises:

generating the current training record data based on the at least one current muscle vibration signal; and adjusting the resistance force of the at least one resistance adjustment assembly according to the current training record data.

13. The muscle training method according to claim 12, before producing the at least one current muscle vibration signal based on the current activity of the at least one target muscle by using the at least one vibration detector, further comprising:

detecting at least one reference muscle vibration signal based on a previous activity of the at least one target muscle by using the at least one vibration detector;

generating the reference training record data based on the at least one reference muscle vibration signal;

building the muscle data model based on the reference training record data; and adjusting the resistance force of the at least one resistance adjustment assembly according to the current training record data and the muscle data model.

14. The muscle training method according to claim 13, further comprising:

determining whether the difference value is within the allowable range;

when the difference value is determined to be within the allowable range, a resistance maintaining signal is output to the at least one resistance adjustment assembly so that the at least one resistance adjustment assembly does not change the resistance force; and when the difference value is determined to be not within the allowable range, further determining whether the difference value is positive or negative;

when the difference value is determined to be positive, a resistance decreasing signal is output so that the at least one resistance adjustment assembly decreases the resistance force; and when the difference value is determined to be negative, a resistance increasing signal is output so that the at least one resistance adjustment assembly increases the resistance force.

* * * * *